United States Patent [19]

Graham

[11] 4,275,700

[45] Jun. 30, 1981

[54] THROTTLE BODY HAVING A DEFLECTOR FOR THE THROTTLE BLADE AND IMPROVED ATOMIZATION

[75] Inventor: Kenneth A. Graham, Birmingham, Mich.

[73] Assignee: Chrysler Corporation, Highland Park, Mich.

[21] Appl. No.: 13,337

[22] Filed: Feb. 21, 1979

[51] Int. Cl.[3] ..... F02M 29/00

[52] U.S. Cl. ..... 123/590; 261/65

[58] Field of Search ..... 123/141, 52 MB, 590, 123/591; 261/65, DIG. 74, DIG. 39; 48/180 M, 180 R

[56] References Cited

U.S. PATENT DOCUMENTS

| | | | |
|---|---|---|---|
| 2,589,946 | 3/1952 | Linn | 48/180 R |
| 2,800,314 | 7/1957 | Olson | 261/65 |
| 3,176,704 | 4/1965 | De Palma | 261/65 X |
| 3,393,984 | 7/1968 | Wisman | 48/180 R |
| 3,758,082 | 9/1973 | Kertell | 261/DIG. 39 |
| 3,759,499 | 9/1973 | Lang | 261/65 X |
| 3,841,284 | 10/1974 | Krygowski | 123/590 X |
| 4,105,003 | 8/1978 | Funk | 261/DIG. 39 |
| 4,153,029 | 5/1979 | Ikegaya | 123/590 |

FOREIGN PATENT DOCUMENTS

| | | | |
|---|---|---|---|
| 213488 | 1/1958 | Australia | 133/590 |

*Primary Examiner*—Harry N. Haroian
*Attorney, Agent, or Firm*—Newtson & Dundas

[57] ABSTRACT

An improvement in preparation of a combustible mixture for an internal combustion engine comprises a throttle body having a butterfly-type throttle blade with a deflector mounted on the upstream face of the blade to deflect sprayed fuel against the juxtaposed wall portion of the induction port.

4 Claims, 11 Drawing Figures

THROTTLE BODY HAVING A DEFLECTOR FOR THE THROTTLE BLADE AND IMPROVED ATOMIZATION

CROSS REFERENCE TO A RELATED APPLICATION

Gordon W. Fenn, "Throttle Body and Mixing Tube", Ser. No. 13,338 filed of even date, and commonly assigned.

BACKGROUND AND SUMMARY OF THE INVENTION

This invention pertains to throttle body assemblies for use with internal combustion engines and is particularly concerned with a new and improved throttle body having a blade-mounted deflector for improved atomization and distribution of fuel, particularly advantageous for use in conjunction with an electronic fuel metering system.

Electronic fuel metering systems offer important advantages and benefits over other types of fuel preparation systems for internal combustion engines. In an electronic fuel metering system the quantity of fuel to the engine is metered electronically in accordance with certain control parameters. An example of such an electronic fuel metering system is shown in U.S. Pat. No. 3,935,851 assigned to the same assignee as the present application. A particularly desirable way to introduce the fuel into the engine induction passage is by utilizing one or more fuel spray bars which spray fuel as distinct jets into the induction passage. An example of such fuel spray bars is shown in U.S. Pat. No. 4,132,204, also assigned to the same assignee as the present application. In this latter patent, the throttle body assembly which is used with the disclosed spray bar system has rectangular shaped induction ports with a pair of counter-rotatable throttle blades disposed in each port. Fuel is sprayed centrally of each port toward the opening defined between the juxtaposed edges of the throttle blade pair.

There are certain advantages to throttle bodies which incorporate circular induction ports, as opposed to rectangular or other shaped ports. For one, a circular shaped port is generally easier to machine from a rough casting than is a rectangular shaped port. Also, the circular shape is akin to that used in conventional, commercially available carburetors, and hence allows use of more or less conventional butterfly-type throttle blades. Heretofore however, the use of circular port throttle bodies and butterfly type throttle blades in conjunction with an electronic fuel metering system has been considered impractical for the purpose of achieving compliance with mandated governmental regulations relating to vehicle exhaust emissions and fuel economy.

The present invention provides a solution which is capable of rendering the use of circular port throttle bodies compatible with an electronic fuel metering system toward achieving compliance with mandated regulations. Thus, the invention means that a fuel management system can incorporate the benefits both of electronic fuel metering technology and more or less conventional carburetor manufacturing technology isofar as the latter relates to manufacturing of the circular ports and blades. The invention requires a minimal number of parts, is of economical manufacture and performs well.

The invention relates to the provision of a blade-mounted deflector which deflects fuel against a juxtaposed portion of the induction port wall thereby alleviating to a certain extent the inherent tendency of a butterfly-type throttle blade to direct a disproportionate amount of fuel against the opposite wall portion.

The foregoing features, advantages and benefits of the invention, along with additional ones, will be seen in the ensuing description and claims which are to be considered in conjunction with the accompanying drawings. The drawings disclose a preferred embodiment of the present invention according to the best mode presently contemplated in carrying out the invention.

DESCRIPTION OF THE PREFERRED EMBODIMENT

Figure 2:
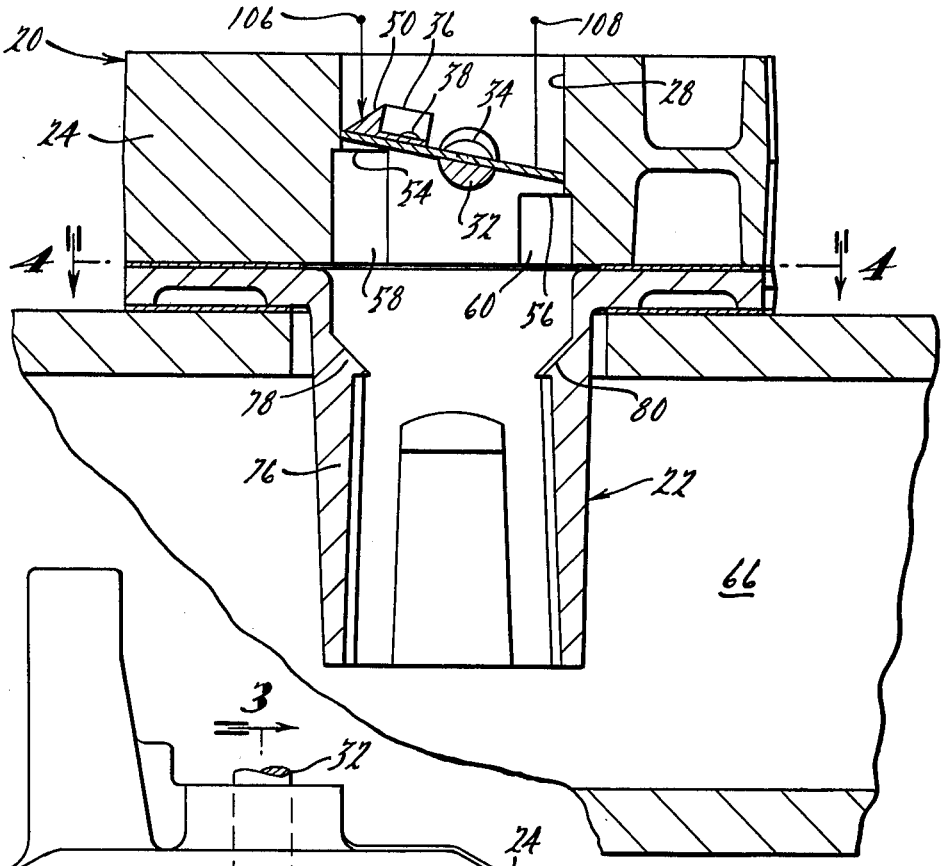
FIG. 2 is a vertical sectional view taken in the direction of arrows 2—2 in FIG. 1.

Looking first to FIGS. 1–5, the reader will see a throttle body assembly 20 incorporating principles of the present invention, in association with a mixer or diffuser, 22. Throttle body assembly 20 comprises a throttle body 24 having a pair of circular induction ports 26, 28. Disposed within each induction port is a generally circular, flat throttle blade, or disc, 30. A shaft 32 journaled on throttle body 24 for rotation about its own axis passes across the throttle body extending through both induction ports. The otherwise circular shaft has localized recesses in the induction ports so that the flat throttle blades may be conveniently and securely attached thereto by means of screws 34. The axis of shaft 32 is offset slightly from the axis of each induction port (slightly to the right as viewed in FIGS. 1, 2 and 5) so that as viewed in FIGS. 2 and 5 the throttle blades tend to be self-closing in the counterclockwise direction when in use. Although the actuating mechanism for rotating throttle shaft 32 is not shown in the drawings, it will be appreciated that the mechanism is operative to selectively rotate the throttle blades away from the closed position shown in FIGS. 2 and 5 in the clockwise direction over a range of operative positions to a wide open throttle position wherein the blades approach a vertical orientation (for example, similar to that shown in FIG. 11). With the blades displaced from the closed position, there are created in each induction port a right hand opening (defined by the right hand, essentially semi-circular, edge of the blade and the right hand half of the port wall) and a left hand opening (defined by the left hand, essentially semi-circular, edge of the blade and the left hand half of the port wall). Thus, it will be appreciated that the structure thus far described may be considered as being generally conventional, with the blades being of the well-known butterfly type in common use in automotive carburetors. The throttle body assembly 20 and mixer 22 mount on a dual plane intake manifold 66 (appearing only in FIG. 2) with each tube 74, 76 passing through a suitable opening in the upper wall of the manifold and into a corresponding plane of the manifold.

Figure 8:
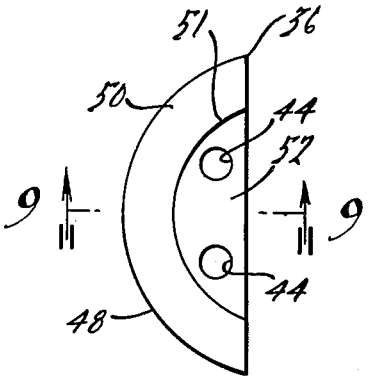
FIG. 8 is a plan view of a deflector used in the throttle body assembly, and shown by itself.

In accordance with principles of the present invention a deflector 36 is attached to the upstream face of each throttle blade 30 by means of a pair of rivets 38. Each deflector 36 is disposed on the portion of the blade which swings upstream as the blade is increasingly opened. Each throttle blade 30 has a pair of holes 40 (see FIG. 6) via which screws 34 pass to attach the blade to the throttle shaft and a pair of holes 42 via which rivets 38 secure the deflector to the blade. Each deflector 36 includes a pair of holes 44 (see FIG. 8) for attachment thereof to the throttle blade by rivets 38. Deflector 36 has a flat base 46 disposed against throttle blade 30, and an arcuate edge segment 48 which extends around a segment of the margin of the throttle blade. A deflection surface 50 inclines from the arcuate edge segment 48, as viewed in a radial cross-section with the throttle blades in the position shown in FIGS. 1, 2 and 5, radially inwardly in the upstream direction. The deflection surface 50 terminates in an arcuate upper edge 51 opposite edge 48. A thin web of material 52 which forms a portion of the flat base surface 46 contains the two holes 44 used to secure the deflector to the disc. The purpose of the deflector 36 is to assist in directing fuel toward the juxtaposed left hand half of each induction port wall (as viewed in FIGS. 1, 2 and 5) over at least a portion of the operative range of displacement of the throttle blades from the closed position shown in these FIGS. so that fuel is directed through the left hand opening. Because each throttle blade, per se, inclines toward the right hand portion of its induction port wall, fuel introduced upstream of the blades will tend to be inherently directed toward the right hand half of the port wall and through the right hand opening. Absent deflector 36 there would tend to be a greater disparity in fuel distribution between the right hand and left hand openings. Fuel from orifices 102 (to be hereinafter described) without deflector 36 would flow down the inclined blade 30 from left to right causing excessive fuel to pass on the right side of the blade. Deflector 36 lessens this disparity so that better atomization and distribution of fuel occur.

A further improvement is achieved by providing sharp edges 54 and 56 respectively on the walls of the induction ports. The sharp edge 54 is located in the left half of the port wall just slightly below the left edge of the throttle blade and the edge 56 in the right half just below the right edge of the throttle blade. A convenient way to provide these sharp edges is by means of undercuts 58 and 60, respectively which can be made by inserting a mill whose diameter is slightly smaller than that of the diameter of the induction port a predetermined distance into the port and advancing the mill radially outwardly to form each of the two undercuts. This results in each shearing edge being defined by a corresponding undercut which has a radius of curvature less than the radius of the shearing edge defined thereby. The advantage of providing the sharp edges 54, 56 is that fuel which is directed against the walls of the port by the throttle blade and deflector tends to be sheared off the edges by the high velocity induction air stream thereby promoting improved fuel atomization.

A passage 62 which intercepts each induction port 26, 28 at an edge of the corresponding undercut 60 serves to communicate via a port 64 with external equipment, such as a PCV emissions control system. Similar arrangements, such as referenced by the numeral 65 in FIG. 1 can be employed for other systems, such as evaporative emissions control systems.

Figure 1:
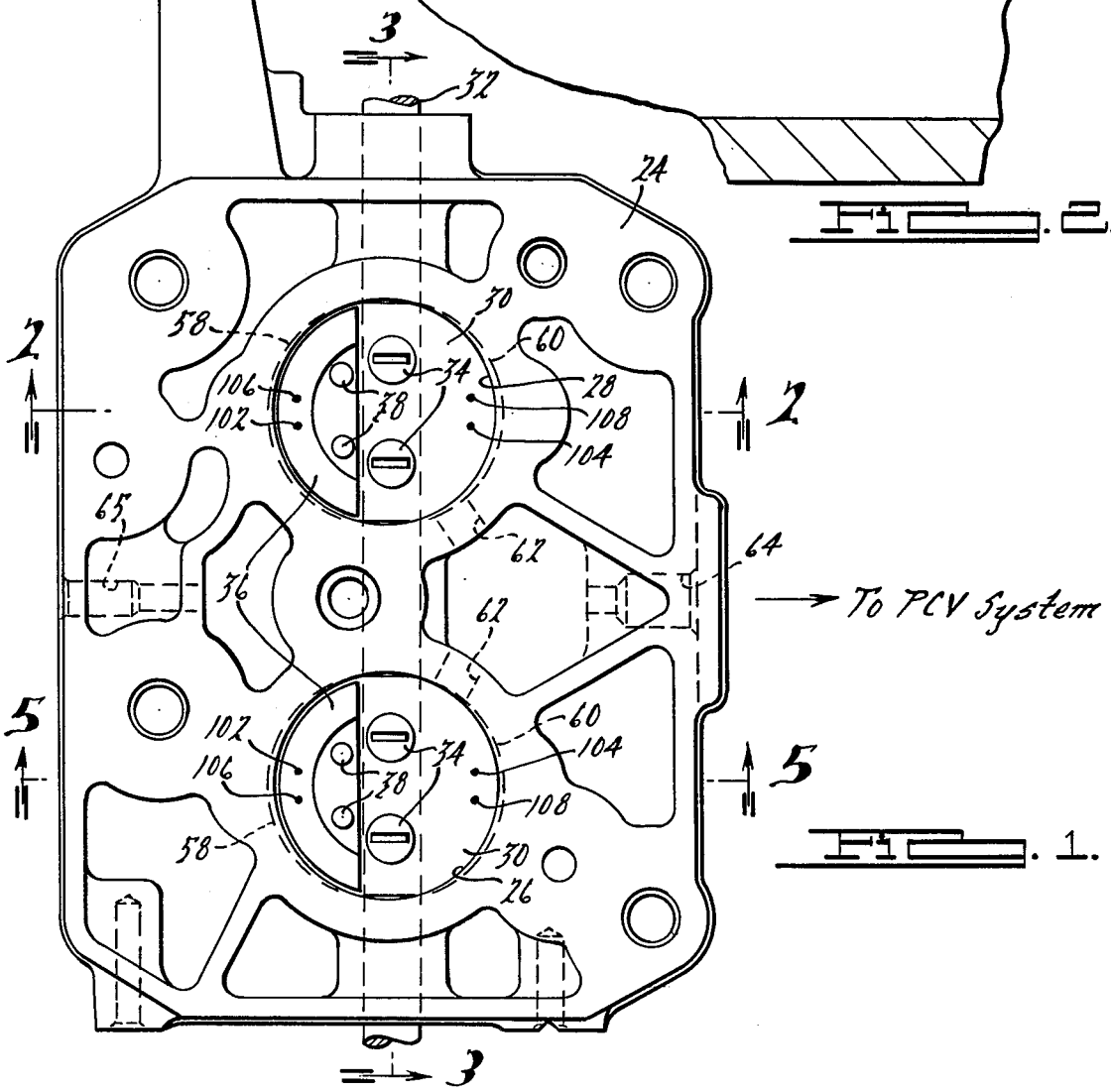
FIG. 1 is a top, plan view of a throttle body assembly embodying principles of the present invention, and related structure.
Figure 4:
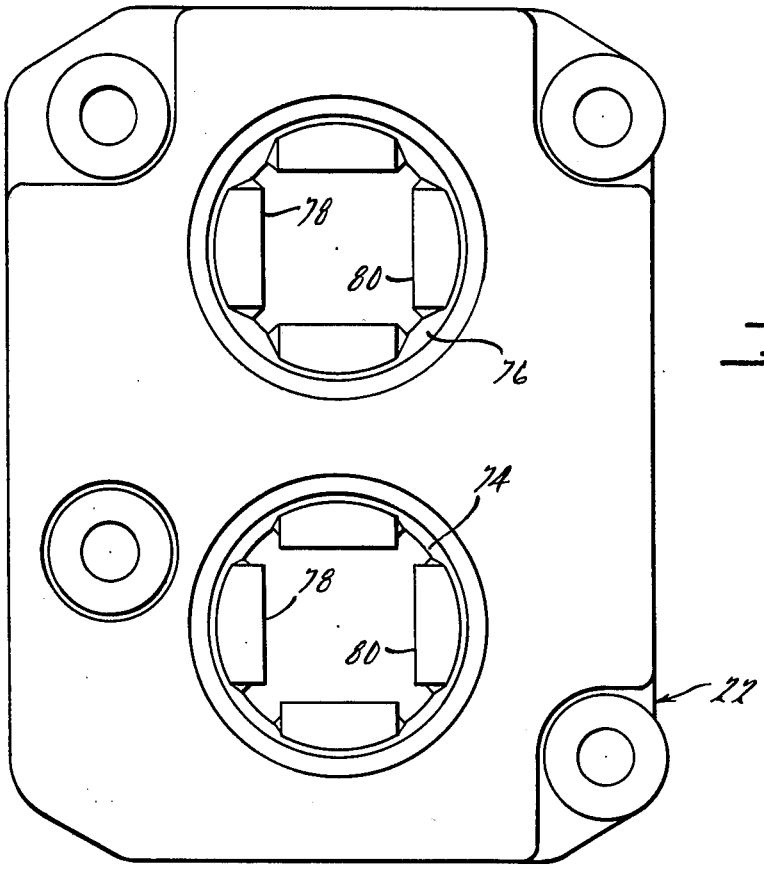
FIG. 4 is a horizontal sectional view taken in the direction of arrows 4—4 in FIG. 2.
Figure 3:
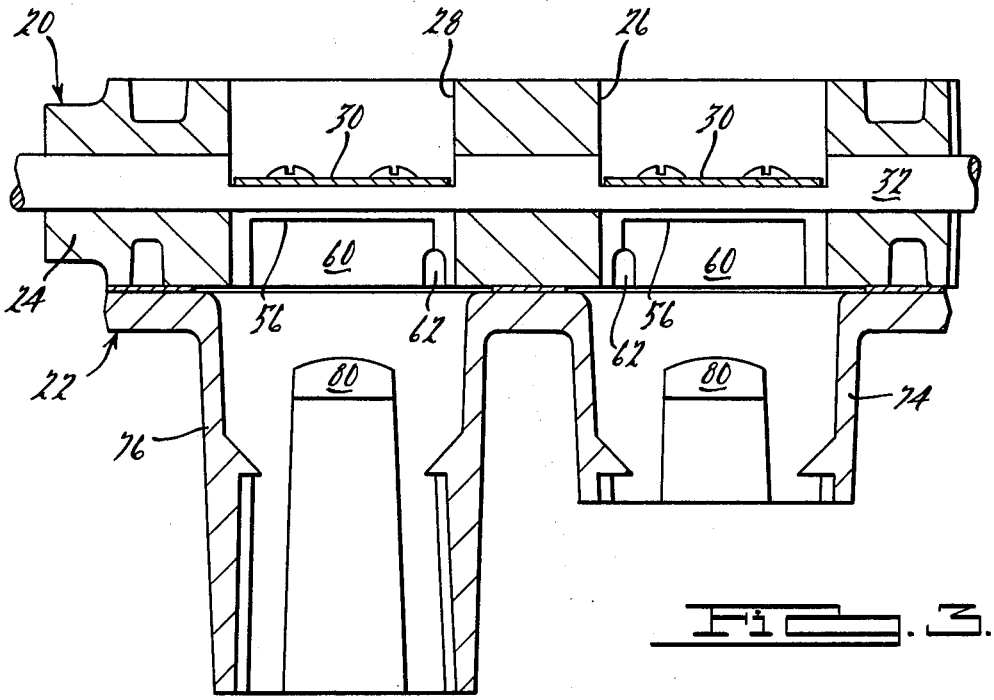
FIG. 3 is a vertical sectional view taken in the direction of arrows 3—3 in FIG. 1.
Figure 5:
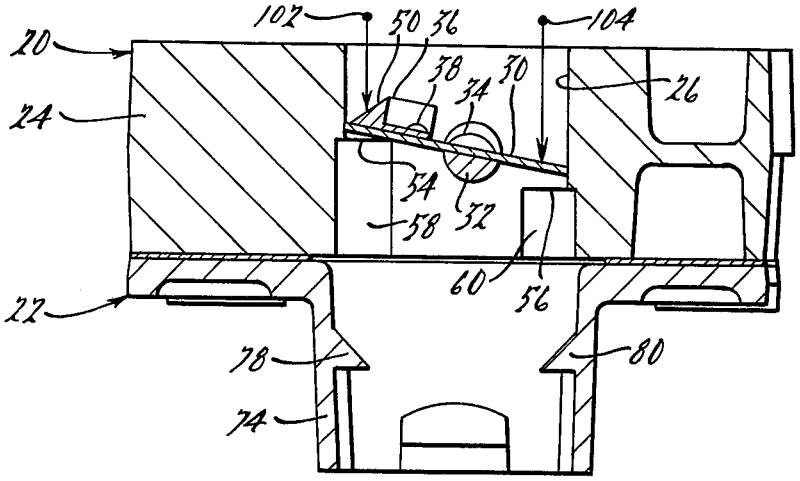
FIG. 5 is a vertical sectional view taken in the direction of arrows 5—5 in FIG. 1.
Figure 6:
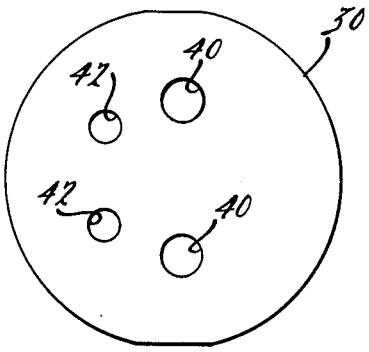
FIG. 6 is a horizontal view of the throttle blade used in the throttle body assembly, and shown by itself.

In the preferred use of the throttle body assembly of the present invention a fuel spray bar system is located directly above each throttle blade. Details of such a spray bar system may be found in U.S. Pat. No. 4,132,204, referred to earlier. Associated with each induction port are a main fuel rail and a separate power fuel rail. The main fuel rail is intended to spray fuel into the port at all times during operation while the power rail sprays fuel only when increased power is demanded. The main rail for each port comprises two orifices 102, 104 respectively which are located as shown in FIGS. 1 and 5. As can be seen, each orifice 102 is poised to spray a jet of fuel directly onto the deflection surface 50 of the corresponding deflector 36, as indicated by the arrow. Each orifice 104 sprays fuel onto the right hand portion of each throttle blade, also indicated by an arrow. Similarly, each power rail has a pair of orifices 106, 108 respectively, with each power orifice 106 poised to spray a jet of fuel into the left hand side of its induction port and each orifice 108 the right hand side of its port. From consideration from FIGS. 2 and 5, it will be appreciated that fuel sprayed from each main orifice 102 will be deflected by the corresponding deflector 36 when the throttle blades are within a certain range of open positions adjacent the closed position shown in these two figures. This serves to deflect fuel against the left hand wall of each port. However, for throttle blade openings greater than this certain range, fuel sprayed from main orifices 102 will not impinge upon the deflectors but instead will be sprayed toward deflectors 78 in tubes 74, 76 of mixer 22. Likewise, main orifices 104 will spray directly toward deflectors 80 in tubes 74, 76, instead of onto the right hand portions of the blades. This will occur only under heavier engine loads where there is a higher volume of air flow through the induction ports which to some extent will compensate for deflectors 36 being out of the path of sprayed fuel from orifices 102. The power spray bars will typically become effective only under heavier engine loads and fuel sprayed from orifices 106, 108 respectively will be directed toward deflectors 78 and 80 also. It can be advantageous to make each left hand orifice of a slightly larger size than that of the corresponding right hand orifice so that each left hand orifice sprays at a higher flow rate than the corresponding right hand orifice. This helps toward achieving more uniform fuel distribution between the right hand and left hand halves of each induction port.

Figure 7:
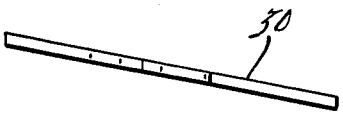
FIG. 7 is a view of the throttle blade of FIG. 6 shown in front elevation.
Figure 9:
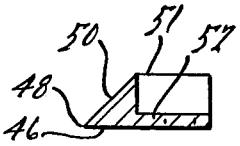
FIG. 9 is a sectional view taken in the direction of arrows 9—9 in FIG. 8.
Figure 10:
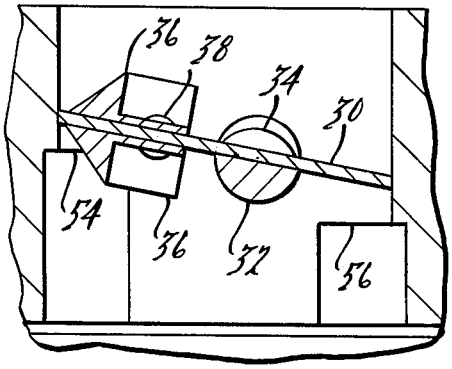
FIGS. 10 and 11 are fragmentary sectional elevational views on an enlarged scale illustrating a modified embodiment in closed and open positions.
Figure 11:
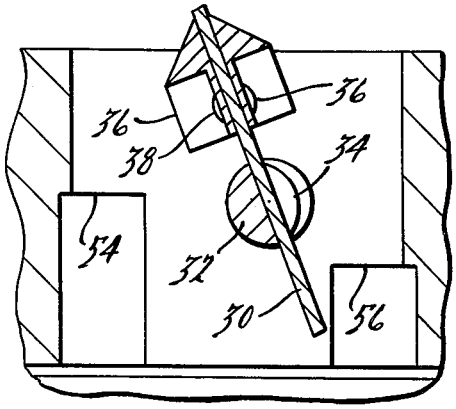

FIG. 10 shows enlarged detail of a modification with the blades in the closed position, and FIG. 11 with the blades approaching a full open position. In this modification a second deflector 36 is attached to the downstream face of each blade as shown for improving distribution even further. Details of this modification, as well as of mixer 22, can be found in the cross-referenced Gordon W. Fenn application. It can be seen in these two FIGS. that the edge 48 is not precisely congruent with the peripheral edge of the throttle blade, and it is believed that exact congruency is not critical to the invention. This slight imprecision arises from expediencies in designing the blades and the deflectors for manufacture. Blades can best be made by striking with the blade blank inclined as in FIG. 7, and thus in a true plan view, the blades are not exactly circular. However, it is more convenient to make the edges 48 of the deflectors truly circular. When the deflectors are assembled to the blades, slight mis-match occurs along their respective edges, but, as mentioned, is not believed critical. The blades may be punched from sheet material, aluminum for example. The throttle body and mixer may be made from cast aluminum. The deflectors may be made from cast magnesium.

While a preferred embodiment has been disclosed, it will be appreciated that modifications and variations may be made within the scope of the following claims.

What is claimed is:

1. In a throttle body assembly having a throttle body, a circular induction port extending through said throttle body, and a generally circular flat throttle blade disposed in said port and mounted on a rotatable throttle shaft which extends centrally transversely across the port for selectively throttling same and selectively positionable between a closed position and a fully open position, the improvement which comprises a deflector element disposed on that half of the upstream face of the throttle blade which swings upstream as the throttle blade is increasingly opened from the closed position, said deflector element comprising a flat base disposed against the upstream face of the throttle blade, a thin web forming a portion of said base, and an arcuately extending deflector segment raised relative to said web and comprising a deflection surface which extends arcuately along a segment of the circumferential margin of said half of the throttle blade but stops short of the other half of the upstream face of the throttle blade and in a radial section with the blade in the closed position inclines radially inwardly in the upstream direction, aperture means in said web and throttle blade, and fastening means disposed in said aperture means securing said deflection element to the throttle blade said assembly also including means for directing a jet of fuel to impinge upon the deflection surface when the throttle blade is within a certain range of open positions adjacent the closed position.

2. The improvement set forth in claim 1 including means defining a sharp edge on the wall of the induction port extending circumferentially substantially coextensive with the circumferential extent of the deflection surface and disposed downstream of said segment of the circumferential margin of said half of the throttle blade.

3. The improvement set forth in claim 2 further including means defining a sharp edge on the wall of the induction port opposite the first mentioned edge and disposed downstream of the marginal portion of the throttle blade which is diametrically opposite said segment of the circumferential margin of said half of the throttle blade.

4. The improvement set forth in claim 1 including means for directing a jet of fuel to impinge upon the deflection surface.

* * * * *